United States Patent [19]

Petrick, Sr.

[11] 4,112,911

[45] Sep. 12, 1978

[54] BALL COLLECTOR AND PROJECTOR APPARATUS

[75] Inventor: Paul J. Petrick, Sr., Joppa, Md.

[73] Assignee: Shooting Star Tennis, Arlington, Va.

[21] Appl. No.: 782,359

[22] Filed: Mar. 29, 1977

[51] Int. Cl.[2] ..... F41F 1/04

[52] U.S. Cl. ..... 124/56; 124/51 R; 124/51 A; 273/29 R

[58] Field of Search ..... 273/29 R, 29 A, 26 R, 273/26 A, 26 D, 129, 35 B, 30; 124/51 A, 51 R, 56, 81, 7, 50, 51, 52, 82; 221/92, 106

[56] References Cited

U.S. PATENT DOCUMENTS

| | | | |
|---|---|---|---|
| 1,258,018 | 3/1918 | Kilgore | 124/51 R |
| 2,087,575 | 7/1927 | Littell et al. | 273/29 R |
| 2,199,009 | 4/1940 | Perryman | 124/51 R |
| 2,716,973 | 9/1955 | Desi | 124/1 |
| 3,009,703 | 11/1961 | Jentsch et al. | 124/51 A |
| 3,089,476 | 5/1963 | Wolverton | 124/51 A |
| 3,548,802 | 12/1970 | Green | 124/51 R |
| 3,905,349 | 9/1975 | Neilson et al. | 124/51 R |
| 3,911,888 | 10/1975 | Harvath | 124/51 A |
| 3,917,265 | 11/1975 | Schrier et al. | 273/30 |
| 3,989,245 | 11/1976 | Augustine, Jr. et al. | 273/29 A |
| 4,021,037 | 5/1977 | Torbet | 124/51 A |

*Primary Examiner*—Richard C. Pinkham
*Assistant Examiner*—T. Brown
*Attorney, Agent, or Firm*—Bernard & Brown

[57] ABSTRACT

Apparatus that collects and transports generally spherical objects, such as tennis balls, and recycles them to a practice device that propels the balls to a tennis player for practice or recreation. Balls are fed one at a time to a chamber from whence they are metered to a transport device without jamming or bridging. Balls are fed or conveyed to a ball delivery zone by a pair of oppositely moving and aligned conveyor belts, each belt being located on opposite sides of the delivery zone. The delivery zone is of such dimensions that only one ball at a time can fall downwards thereinto. Located within the delivery zone is a horizontally reciprocating piston and oppositely opposed thereto and in alignment therewith is a ball exit port communicating with a vacuum tube leading to a pneumatic ball projector. As balls enter the delivery zone, they are fed through the exit port by the reciprocating cylinder and into the vacuum tube and served to a player by means of the projector.

12 Claims, 4 Drawing Figures

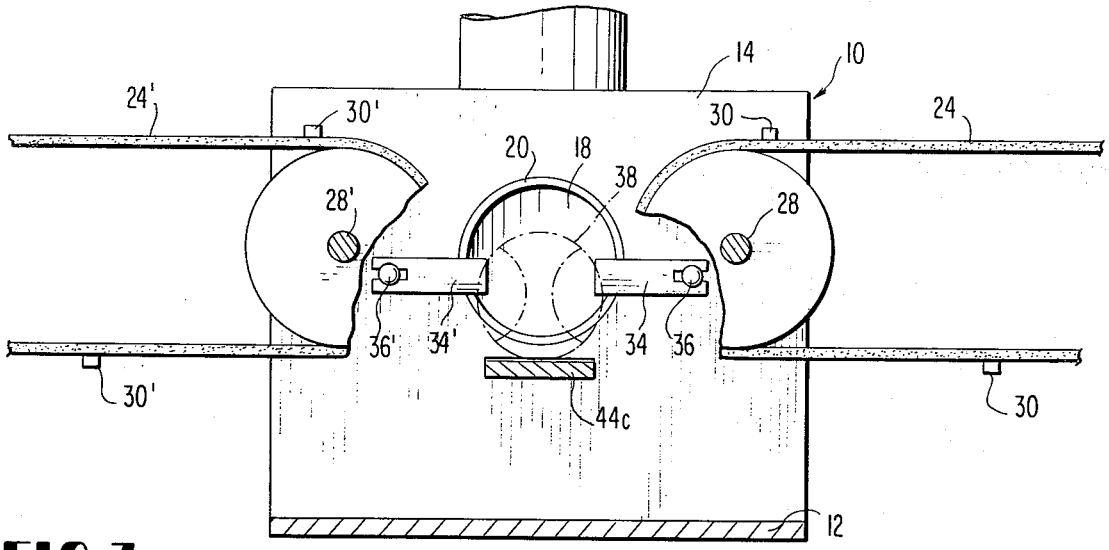
FIG. 3
FIG. 4
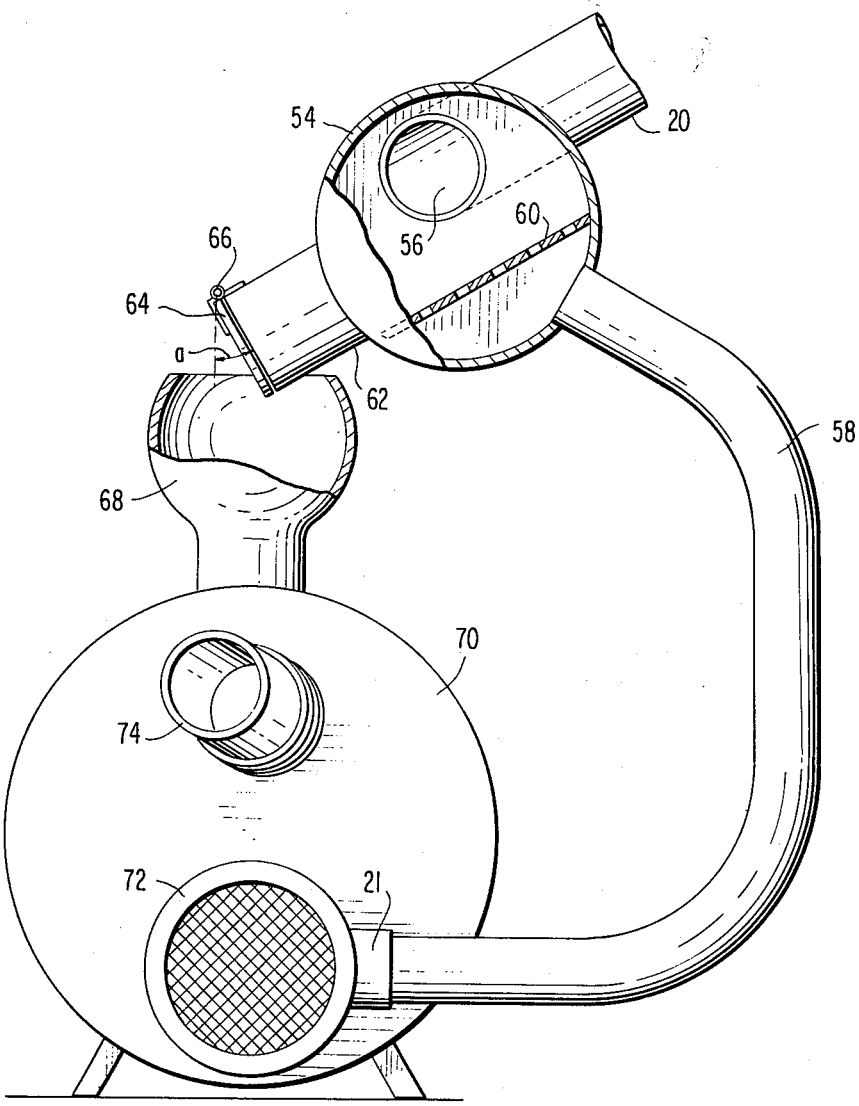

BALL COLLECTOR AND PROJECTOR APPARATUS

This invention relates to apparatus for collecting and transporting generally spherical objects. The apparatus of this invention is particularly useful in a system for recovering and recycling tennis balls to a tennis practice device for propulsion to a tennis player for practice or recreation.

By this invention there is provided apparatus which is suitable for collecting and transporting generally spherical objects such that a single spherical object at a time is fed to a transport means. Advantageously, the apparatus of the invention is self-clearing of jams caused by one or more of the spherical objects. The jams may occur, for instance, during collecting and feeding spherical objects to the transport means. Moreover, in the event of a jam, the operation of the apparatus, even during clearing of the jam, may not be deleterious to the spherical objects. Any spherical object involved in a jam is still capable of being directed into the transport means after the jam is cleared by the normal operation of the apparatus.

A particularly attractive application of the apparatus of this invention is in the collection and delivery of game balls, e.g., tennis balls. In recent years the growing popularity of tennis has resulted in increased demand for practice devices for propelling tennis balls to a tennis player to hit for practice or recreation. Thus, the tennis player does not need a partner for practicing or enjoying tennis when a practice device is employed. Moreover, it is only necessary that the practice device simulate game conditions, and thus the practice area may comprise less than a full tennis court thereby saving space. Many of these practice devices are adapted to automatically deliver balls to the waiting tennis player at periodic intervals. Thus, a plurality of balls may be directed to the tennis player without need for the tennis player or other individual to approach the practice device. However, unless a means is provided for recycling tennis balls, frequently only about 50 percent of the practice time can be used for tennis practice with the other 50 percent of the practice time being devoted to picking up and returning balls to the practice device. Especially with the growing popularity of commercial hitting lanes and other courts particularly adapted to the practice of tennis, it is desirable to recover spent balls and recycle them to the practice device without the need of the tennis player or an attendant to return the balls to the practice device. It is also desirable to provide a means for recovering and recycling the balls to the practice device which is essentially trouble-free and which during normal operations or in the event of a jam is not deleterious to either the tennis balls or the recovering and recycling means. Tennis balls, however, have been particularly difficult to recover and transport because of their tendencies to form aggregates due to their nap covering. The aggregates may result in blockages and even jams of the recovering and recycling apparatus.

One proposal for collecting and elevating balls is disclosed in U.S. Pat. No. 2,087,575 wherein a conveyor belt system having buckets is employed to collect balls from a lower, collection zone and deliver them to an elevated hopper. In commercial recycling devices which employ a conveyor belt having buckets, the balls in the elevated hopper are often delivered by gravity to a practice device. Commonly, the feeding mechanism from a hopper to the propulsion mechanism of the practice device comprises a plate having a hole therein which is adapted to receive a single ball and a gate thereunder to regulate the flow of balls to the propulsion mechanism. Several difficulties may occur with this type of device. For instance, the tennis balls may form aggregates, or a bridge, in the hopper, thus preventing tennis balls from entering the hole, and the tennis player or attendant must manually break-up the aggregation. Also, it is possible for a ball to become wedged between the walls of the hole and the gate. This wedging could result in damage to the ball upon closing of the gate, and the drive system for the gate could stall thereby resulting in potential damage to the power source for the gate. Accordingly, clutch mechanisms have been incorporated into the practice devices to prevent damage to jammed balls or the power source. These clutch mechanisms are relatively expensive, and still the tennis player or attendant must unwedge the jammed ball by hand. U.S. Pat. No. 3,989,245, for instance, employs a pneumatic line for elevating and propelling tennis balls.

In accordance with this invention apparatus for collecting and transporting generally spherical objects is provided. The apparatus is particularly suitable for treating spherical objects having surfaces which promote the formation of aggregates, e.g., nap coverings such as on tennis balls. The apparatus comprises a chamber which is sufficiently small that only a single spherical object at a time can enter the chamber through an upper inlet opening thereof. An object exit port is provided in an upwardly-extending wall of the chamber and is in communication with a transport means. Restraining means is provided adjacent the object exit port and serves to restrain a spherical object from passing to the transport means. The chamber is sufficiently small in volume that the presence of a spherical object therein can block the upper inlet opening so that another spherical object does not enter a delivery portion of the chamber. Moreover, due to the size of the chamber, the spherical object may be the apparatus of this invention advantageously desirably positioned with respect to the object exit port in order to abate any undue risk of jamming the apparatus. In order to assume that a single spherical object is fed to the chamber and avoid jamming or bridging the opening, spherical objects are directed to the upper inlet opening of the chamber by moving support means having projections affixed thereon which are adapted to contact and thus impart motion to said spherical objects. The motion imparted to the spherical objects breakes up any bridging of spherical objects which may occur at the upper inlet opening and thus promotes the feeding of a single spherical object at a time to the chamber.

An incompressible contact means is provided in the chamber to contact a spherical object and force it past the restraining means, through the exit port and to the transport means. Advantageously, a gate means is provided such that while the spherical object is being forced by the contact means through the restraining means, another spherical object does not interfere with its delivery. Preferably, the functions of both the gate means and the contact means can be provided by a displacement means. The displacement means can move from an open position whereat a spherical object is permitted to pass into the delivery portion of the chamber to a closed position during which movement it can contact and force the spherical object through the object exit port. Each of the gate means and contact means, or the displacement means, can be in communication with a resilient drive means such that in the event that a spherical object is mispositioned in the delivery portion of the chamber, neither the apparatus nor the spherical object is deleteriously affected during the closing or contacting. During opening of the gate and withdrawing of the contact means the mispositioned spherical object may assume a correct position with respect to the resilient restraining means for being contacted and forced through the object exit port on the next cycle of the contact means or otherwise be cleared.

In an aspect of the invention, the collecting and transporting apparatus is employed in conjunction with a delivery system and the transport means comprises a vacuum conduit in communication with a vacuum source. The delivery system comprises a plenum in communication with the vacuum conduit and is sufficiently large, i.e., to sufficiently decrease the air velocity, that the spherical object can be removed from suspension. The plenum is advantageously constructed such that when the spherical object is removed from suspension, a spherical object removal means is activated and the object can be released. The removal means desirably can be a flap valve which is caused to be opened by contact with a spherical object and is closed once the object has been released by the vacuum suction.

The invention will be further described in an embodiment of a tennis ball recovering and recycling system. It is to be understood, however, that this description is illustrative, and not in limitation, of the invention. The description regarding a tennis ball recovering and recycling system is with reference to the drawings in which:

FIG. 3 is a schematic partial view of an upwardly-extending member defining an object exit port in the apparatus of FIG. 1; and FIG. 4 is a schematic side elevation of a plenum in communication with the collecting and transporting apparatus of FIG. 1 with partial break-away sections.

Figure 1:
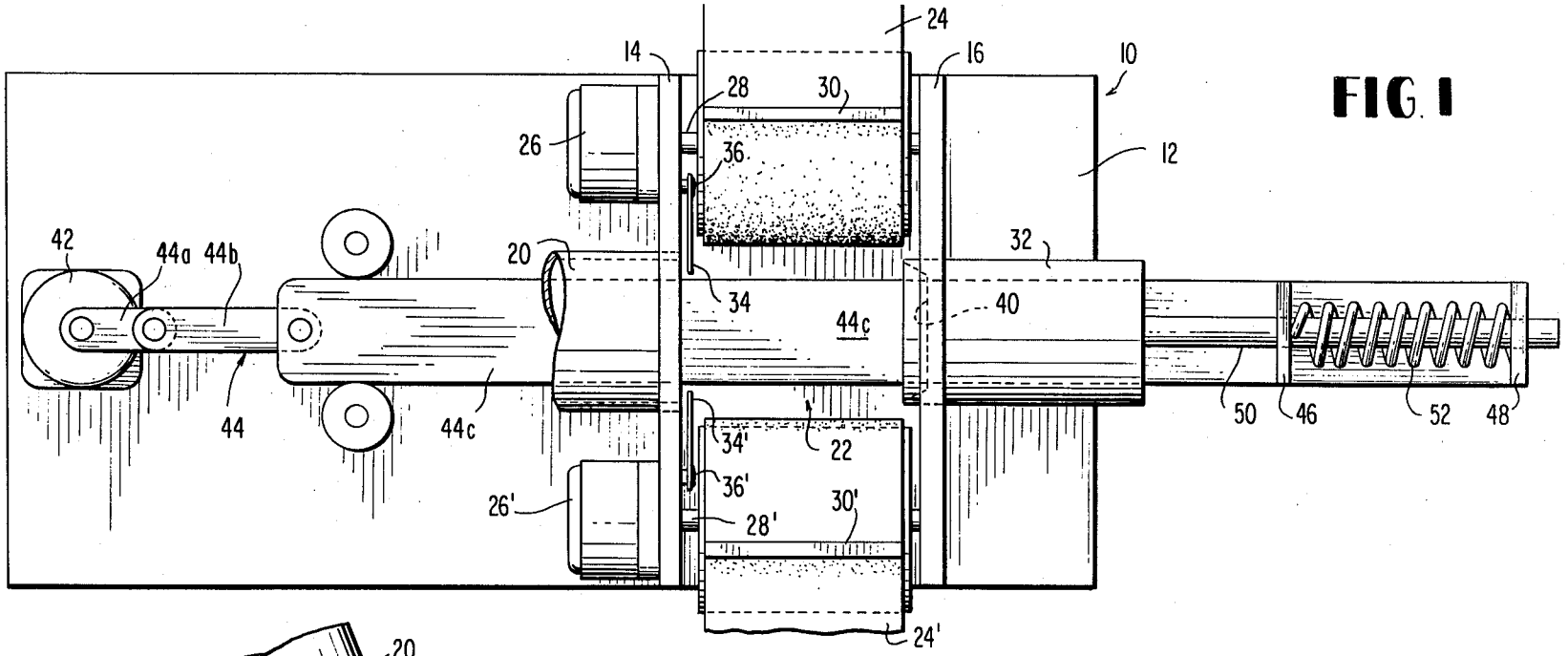
FIG. 1 is a schematic view of a tennis ball collecting and transporting apparatus of this invention.
Figure 2:
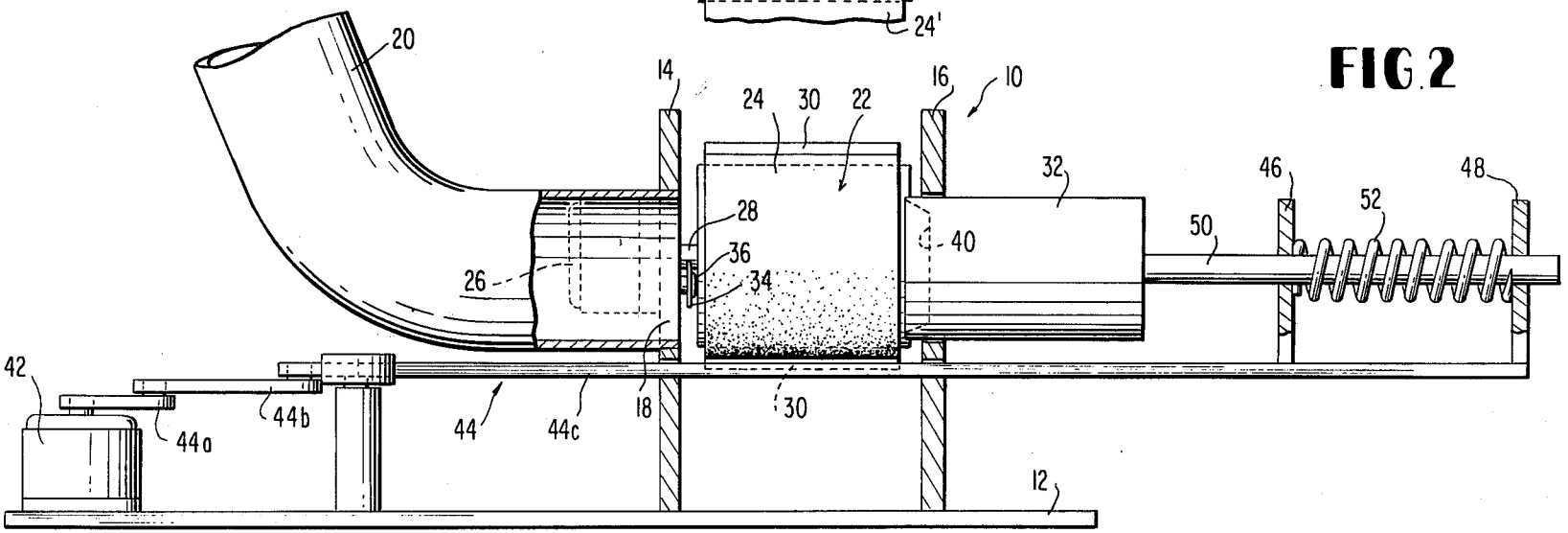
FIG. 2 is a schematic side elevation view with a partial cross-section of the collecting and transporting apparatus of FIG. 1.

With reference to FIGS. 1, 2 and 3, the numeral 10 generally designates the frame of the collecting and transporting apparatus. The frame comprises base support 12 and extending upwardly from base support 12 are front vertical support member 14 and rear vertical support member 16. The support members are often about 3 to 5 inches apart. Front vertical support member 14 defines in a central portion a vacuum inlet port (object exit port) generally indicated by the numeral 18. Vacuum inlet port is sufficiently large to receive a tennis ball which is about 2½ inches in diameter. The inlet port may conveniently have a generally circular cross-section having a diameter of about 2¾ to 4, preferably about 3, inches. Integral with the vacuum inlet port and extending from a front side of vertical support 14 is vacuum conduit 20 which has a sufficiently large cross-section to allow a tennis ball to pass therethrough, e.g., about 2¾ to 4, preferably about 3, inches in diameter. The other end of vacuum conduit is in communication with a vacuum source 21 (a venturi illustrated in FIG. 4) and often the vacuum is at least about 3, preferably at least about 5, pounds per square inch below atmospheric pressure. The zone generally extending from the rear side of vertical support 14 behind vacuum inlet port 18 and bounded by the front side of vertical support 16 is herein referred to as a delivery portion of chamber 22. Chamber 22 may be open to the atmosphere.

Conveyor belts 24 and 24' serve as the moving support means and extend in an essentially lateral direction from chamber 22. The conveyor belts terminate between vertical support members 14 and 16, are diametrically opposed each other and are directed toward chamber 22. Frequently, the conveyor belts are substantially horizontal. The space between the opposed ends of conveyor belts 24 and 24' at chamber 22 defines an upper opening to chamber 22, and the opening is sufficient to enable a tennis ball to pass between the belts and fall downwardly in chamber 22. Conveniently the opening is about 2¾ to 4 inches wide. Each of the conveyor belts can extend through a collection trough (not shown) which receives tennis balls. The conveyor belts are motivated by motors 26 and 26' and drive shafts 28 and 28'. The upper flight of each conveyor belt moves toward chamber 22. Each conveyor belt is provided with outwardly-extending traverse ridges 30 and 30' which are often about ⅛ to ½ inch in height which serve to assist in directing the tennis balls along the path of the conveyor belts. The ridges may be spaced at least about 4, e.g., about 6 to 12, preferably about 9, inches apart. The tennis balls may tend to stack up, or bridge, over the opening between the ends of the belts, and ridges 30 and 30' can also serve to keep the tennis balls in agitation and thus break-up any aggregates over the opening that may form.

The tennis balls may be directed to conveyor belts 24 and 24' in any suitable manner. For instance, in a hitting lane which may have the length of a full tennis court or less, e.g., a length of about 50 to about 78 feet, but a lesser width, say, about 15 to 20 or more feet, the area on the other side of the net from the tennis player may be inclined from the net towards the end of the court, e.g., for a drop of about 2 feet over distance of about 39 feet, i.e., the inclined area may be at an angle of at least 2.5° to horizontal. Conveyor belts 24 and 24' may be parallel with the end line of the court and can receive tennis balls from the inclined area by gravity.

Piston 32 extends into chamber 22 through rear vertical support member 16 and between conveyor belts 24 and 24' and is adapted to reciprocate towards and away from vacuum inlet port 18. The path of the piston extends sufficiently close to vacuum inlet port 18, that the tennis ball passes to vacuum conduit 20 for transport, e.g., the piston may often be at least within about one inch of the vacuum inlet port at that terminus of the reciprocal path. The other terminus of the reciprocal path is sufficiently distant from vacuum inlet port 18, that a single ball can pass to the delivery portion of chamber 22. Preferably, at its withdrawn position, any exposed upper surface of piston 32 extending forward from rear support member 16 is insufficient to permit a ball to rest thereon. The length of the reciprocal path is sufficient that a ball need not contact the face of the withdrawn piston when in the delivery portion of chamber 22, and the length is often about 2¾ to 3¼ inches. The conveyor belts can be oriented substantially perpendicular to the reciprocal path of the piston. Piston 32 may be of any convenient configuration such as square, triangular, rectangular, oval, circular, or the like. As depicted, piston 32 is generally cylindrical in shape with an axis substantially colinear with the reciprocal path and has a sufficiently large diameter that when positioned between conveyor belts 24 and 24', insufficient room is provided for a tennis ball to pass through the upper opening into the delivery portion chamber 22, e.g., the piston may be about 1 ½ to 3, preferably about 2 to 2½, inches in diameter.

Resilient restraining means are positioned on the rear side of support member 14 in the vicinity of vacuum inlet port 18 to restrain the tennis ball from entering vacuum conduit 20. The resilient restraining means can be adapted to tend to stop the ball from moving beyond the restraining means under the influence of the vacuum. The restraining means are depicted as opposing flexible, thin rectangular bars 34 to 34' positioned approximately one-half inch from support member 14 using fastners 36 and 36'. In FIG. 3, the position of a tennis ball 38 resting against bars 34 and 34' is illustrated by the use of broken lines. Piston 32 contacts tennis ball 38 during its forward movement and forces the ball past bars 34 and 34' into vacuum conduit 20. To assist in the positioning and directing a tennis ball into vacuum conduit 20, piston 32 provided with recessed tip 40 such that the ball does not slide away from inlet port 18 when impacted by piston 32. The tip can be sufficiently recessed such that essentially only the circular exterior of the tip contacts the tennis ball.

A resilient drive means is employed to move piston 32 along its reciprocal path. As depicted, the resilient drive means comprises motor 42 and eccentric mechanism 44. Eccentric mechanism 44 comprises pivotable linkage 44a which is pivotably attached to motor 42, pivotable linkage **44*b* which is pivotably attached to the other end of linkage 44*a*, and rod 44*c* which is pivotably attached to the other end of linkage 44*b*. Rod 44*c* extends through vertical support members 14 and 16 and behind rear vertical support member 16. The upper surface of the portion of rod 44*c* which extends between support members 14 and 16 serves as a ball support for a tennis ball in the delivery portion of chamber 22. As depicted, the lateral sides of the delivery zone are defined by conveyor belts 24 and 24'. Extending upwardly from rod 44*c* and behind the rear vertical support member are spaced apart guides 46 and 48. The guides may be about 3 to 12 or more, preferably about 4 to 8, inches apart. Each guide has a bore therein to receive shaft 50 which is affixed to and extends from piston 32. Shaft 50 is freely movable within the bores of guides 46 and 48. Coil spring 52 is positioned around shaft 50 and extends from guide 46 to guide 48 and is fixedly attached to shaft 50 at a convenient point, e.g., often a point between guide 46 and a midpoint. The force for moving piston 32 is thus transmitted through eccentric mechanism 44 and spring 52 by compression of the spring to shaft 50 and piston 32. Motor 42** may revolve at a predetermined speed thereby causing the delivery of balls at a regular interval, or the motor may be intermittent or irregular and may even be remotely controlled to deliver balls at desirable intervals of time.

In the event that a ball falls into the delivery portion of chamber 22 at the same time that piston 32 is moving toward a closed position and becomes wedged between, e.g., the edge of vacuum inlet port 18 and piston 32, the spring can be sufficiently compressed to permit eccentric mechanism 44 to complete its cycle without damaging the tennis ball or motor 42. Spring 52 has sufficient rigidity, however, that a tennis ball can be forced through vacuum inlet port 18 and into vacuum conduit 20. When piston 32 is withdrawn, the tennis ball can move into a desirable position for subsequent delivery to vacuum conduit 20. Due to the use of the piston, the resilient drive means for the piston and resilient restraining means, the apparatus of the invention is essentially self-clearing of jams. Expensive clutch mechanisms need not be employed in accordance with the invention to avoid damage to a tennis ball or the motor in the event of a jam.

In operation, a tennis ball is conveyed by conveyor belt 24 or 24' to the upper opening of chamber 22. When piston 32 is in the open or retracted position, a ball falls by gravity into the delivery portion of chamber 22. The presence of the ball prevents other balls from entering the delivery portion of chamber 22 while the piston is retracted. At a desired time, the piston is activated and moves toward a closed position. The piston contacts the tennis ball and forces it past the restraining bars 34 and 34' into vacuum conduit 20 where it is transported by force of the suction. Piston 32 then reciprocates to an open position thereby allowing another single tennis ball to enter the delivery portion of chamber 22.

In an aspect of the invention, the tennis ball is transported via vacuum conduit 20 to plenum 54 (see FIG. 4) via port 56. Exiting from plenum 54 is vacuum line 58 which is in communication with vacuum source 21. Within the plenum is inclined plate 60 which is perforated and is oriented such that a tennis ball contacting it is directed by the force of gravity to exit conduit 62 extending from the plenum and the ball gathers momentum. Exit conduit 62 is terminated by a plenum gate means, i.e., flap valve 64 which is pivotably mounted on exit conduit 62 by hinge 66 and flap valve 64 is adapted to be contracted and opened by a ball passing through exit conduit 62. The opening of exit conduit 62 is depicted as being oriented at an angle to vertical which is represented on the drawing as angle "*a*". *Angle* "*a*" is conveniently at least about 10, preferably about 30 to 45° from vertical. Since flap valve 64 is at an angle such that without the vacuum is plenum 54, the flap valve would tend to open, the force, i.e., the momentum of the ball, required for opening the flap valve is lessened. Immediately below the opening of exit conduit 62 in a receiving relationship is hopper 68 for delivery device 70. The delivery device may be any suitable type of delivery device such as rotating disc or discs, spring, pneumatic or the like propulsion devices. The delivery device illustrated is a pneumatic delivery device and comprises air intake 72 which is in a venturi relationship with vacuum line 58 to develop a vacuum therein, i.e., the vacuum source is a venturi. Projection barrel 74 extends from delivery device 70 and serves to direct a propelled tennis ball exiting the delivery device towards a player for hitting.

Advantageously, the collection and delivery apparatus of the invention transports a tennis ball to the delivery device at a time it can be positioned in a discharge chamber of the delivery device. Thus, the use of clutch mechanisms and the like may not be employed on the discharge device. The frequency with which the tennis balls are propelled can then be determined by the frequency of the feeding of tennis balls to vacuum conduit 20 by piston 32.

In operation, a tennis ball being transported through vacuum conduit 20 enters plenum 54 through port 56. The decrease in gas velocity results in the tennis ball's dropping from suspension and contacting inclined plate 60. The ball, under the influence of gravity, rolls down the inclined plate into exit conduit 62, and the weight and speed of the ball when it strikes flap valve 64 are sufficient to break the vacuum and open the flap valve. The flap valve may be appropriately weighted such that for a given vacuum, the momentum of the ball is sufficient to open the flap valve. The ball falls into hopper 68 for delivery to the propulsion mechanism of delivery device 70. The vacuum causes flap valve 66 to return to the closed position.

It is claimed:

1. An apparatus for collecting and transporting generally spherical objects such as conventional tennis balls comprising a frame defining a chamber having an upper inlet opening adapted to receive a said spherical object and a delivery zone adjacent thereto, and an upwardly-extending member defining an object exit port adjacent said delivery zone and of sufficient size to permit a said spherical object to pass therethrough; said delivery zone being dimensioned so as to allow only one spherical object at a time to enter therein; an object moving and support means having ridges outwardly extending therefrom for directing said spherical objects to said inlet opening to pass by gravity to said delivery zone of said chamber; an object transport means in communication with said object exit port; resilient restraining means adjacent to said object exit port sufficient to restrict said spherical object from passing from said delivery zone through said object exit port; contact means in said delivery zone and in normal spaced alignment with said object exit port adapted to be activated to contact and force a said spherical object held by said resilient restraining means through said resilient restraining means and said object exit port into said transport means; and resilient drive means for activating said contact means to move said contact means between a normally open position in which a said spherical object can pass to the chamber and a contact position in which said contact means forces said object through said object exit port.

2. The apparatus of claim 1 in which said contact means prevents another of said spherical objects from entering the delivery zone of said chamber when in said contact position.

3. The apparatus of claim 2 in which said resilient drive means comprises a motor, an eccentric mechanism connecting said motor to said contact means; said eccentric mechanism comprises a first linkage member pivotally attached at one of its ends to said motor, a second linkage member pivotally attached at one of its ends to the other end of said first linkage member, and a horizontally extending rod member slidably attached to said frame, said rod member having one of its ends attached to the other end of said second linkage member and having its other end attached to said contact means; a spring, said spring being attached between said eccentric mechanism and said contact means such that power produced by said motor is resiliently transfered to said contact means through said eccentric mechanism.

4. The apparatus of claim 3 in which said contact means is adapted to move in a substantially horizontal, reciprocal path in line with the object exit port, and the spring is a coil spring and said power is transmitted by compression of the spring.

5. The apparatus of claim 4 in which said contact means is cylindrical, has an axis substantially colinear with the reciprocal path, and has a recessed impact tip.

6. The apparatus of claim 5 in which said object moving support means comprises diametrically opposed conveyors which terminate at said inlet opening to the chamber and which are substantially perpendicular to the reciprocal path of said contact means, and said ridges are transverse to the conveyors.

7. The apparatus of claim 2 in which said object moving support means comprises diametrically opposed conveyors which terminate at said ridges inlet opening to said ridges chamber and said are transverse to the conveyors.

8. The apparatus of claim 1 in which the transport means comprises a vacuum conduit in communication with a vacuum source which is sufficient to propel a said spherical object when in said vacuum conduit.

9. The apparatus of claim 8 in which said vacuum conduit is in direct communication with a plenum adapted to remove a said spherical object from said vacuum, conduit, wherein said plenum comprises spherical object removal means adapted to permit a said spherical object to pass from said transport means.

10. The apparatus of claim 9 in which said spherical object removal means comprises a flap valve which is adapted to be activated by contact with a said spherical object in said plenum to open said flap valve.

11. The apparatus of claim 10 in which said spherical objects are tennis balls, said flap valve is positioned such that a tennis ball passes through said flap valve to a tennis ball delivery device.

12. The apparatus of claim 11 in which said tennis ball delivery device is a pneumatic delivery device having an air intake; said vacuum source is provided by a venturi in communication with said air intake; and a vacuum line connects said vacuum source and said plenum.

* * * * *

UNITED STATES PATENT OFFICE

CERTIFICATE OF CORRECTION

Patent No. 4,112,911 Dated September 12, 1978

Inventor(s) PAUL J. PETRICK, SR.

It is certified that error appears in the above-identified patent and that said Letters Patent are hereby corrected as shown below:

In column 6 line 34 delete "contracted" and insert therefor --contacted--.

Column 6 line 40 delete "is" and insert therefor --in--.

Column 8 line 10 delete "and the" and insert therefor --said--.

Column 8 lines 22, 23 after "moving" insert --and--.

Column 8 line 24 delete "ridges".

Column 8 line 25 delete "ridges".

Column 8 line 25 after "and said" insert --ridges--.

Column 8 line 34 after "vacuum" delete ",".

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*